US007128829B1

(12) United States Patent
Kulprathipanja et al.

(10) Patent No.: US 7,128,829 B1
(45) Date of Patent: Oct. 31, 2006

(54) REMOVAL OF IMPURITIES FROM LIQUID HYDROCARBON STREAMS

(75) Inventors: Santi Kulprathipanja, Inverness, IL (US); Suheil F. Abdo, Lincolnshire, IL (US); James A. Johnson, Clarendon Hills, IL (US); Daniel A. Kauff, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 500 days.

(21) Appl. No.: 10/447,752

(22) Filed: May 29, 2003

(51) Int. Cl.
*C10G 17/00* (2006.01)
*C10G 29/00* (2006.01)
*C10G 25/00* (2006.01)
*C07C 7/12* (2006.01)

(52) U.S. Cl. ..... 208/208 R; 208/243; 208/244; 208/245; 208/306; 208/254 R; 208/307; 585/820; 585/823; 585/829

(58) Field of Classification Search ..... 208/208 R, 208/243, 244, 245, 306, 254 R, 307; 585/820, 585/823, 829
See application file for complete search history.

(56) References Cited

U.S. PATENT DOCUMENTS

| | | | | |
|---|---|---|---|---|
| 2,769,760 | A | 11/1956 | Annable et al. | 196/28 |
| 3,163,593 | A | 12/1964 | Webster et al. | 208/240 |
| 3,341,448 | A | 9/1967 | Ford et al. | 208/211 |
| 3,413,307 | A | 11/1968 | Heimlich et al. | 260/329.3 |
| 3,505,210 | A | 4/1970 | Wallace et al. | 208/228 |
| 3,551,328 | A | 12/1970 | Cole et al. | 208/240 |
| 5,114,689 | A * | 5/1992 | Nagji et al. | 423/230 |
| 5,300,218 | A * | 4/1994 | Graiff et al. | 208/299 |
| 2002/0028505 | A1 * | 3/2002 | Sakai et al. | 435/299.1 |
| 2004/0178122 | A1 * | 9/2004 | Karas et al. | 208/196 |

FOREIGN PATENT DOCUMENTS

| | | |
|---|---|---|
| EP | 0 565 324 A1 | 4/1993 |

* cited by examiner

*Primary Examiner*—Glenn Caldarola
*Assistant Examiner*—John Douglas
(74) *Attorney, Agent, or Firm*—John G. Tolomei; Mark Goldberg

(57) ABSTRACT

A novel process effective for the removal of organic sulfur compounds, organic nitrogen compounds and light olefins from liquid hydrocarbons is disclosed. The process more specifically addresses the removal of these contaminants from aromatic compounds including benzene and toluene and from naphtha. The liquid hydrocarbons are contacted with a blend of at least one metal oxide and an acidic zeolite. Preferably, the metal oxide comprises nickel oxide and molybdenum oxide and the acidic zeolite is acidic stabilized zeolite Y. This blend has a significant capacity for adsorption of impurities and can be regenerated by oxidative treatment.

15 Claims, No Drawings

REMOVAL OF IMPURITIES FROM LIQUID HYDROCARBON STREAMS

FIELD OF THE INVENTION

The present invention relates to a novel process for removing organic sulfur compounds such as thiophenes and other impurities from liquid hydrocarbon streams.

BACKGROUND OF THE INVENTION

Sulfur and other impurities such as organic nitrogen compounds and olefins are present in a wide range of mostly organic forms in both straight run and refined hydrocarbon streams, including, for example, gasoline, diesel fuel, and kerosene. Sulfur contaminants, while ubiquitous in hydrocarbon products, are suspected of causing adverse environmental effects when converted to sulfur oxides ($SO_x$) upon combustion. $SO_x$ emissions are believed to contribute to not only acid rain, but also to reduced efficiency of catalytic converters designed to improve motor vehicle exhaust quality. Furthermore, sulfur compounds are thought to ultimately increase the particulate content of combustion products. Because of these issues, the reduction of the sulfur content in hydrocarbon streams has become a major objective of recent environmental legislation worldwide. The limit for sulfur in the United States, Canada, Japan, the European Community had been at 500 ppm, but recent changes or proposed changes in regulations have called for reducing the maximum limit for diesel sulfur to 5 to 15 ppm, depending upon the applicable regulation.

For the oil refiner, complying with such increasingly stringent specifications has become increasingly difficult as the limits for sulfur and other contaminants have been lowered. In particular, impurities such as thiophenes, organic nitrogen compounds and light olefins share the same boiling point with some desired product streams, such as benzene and toluene and are therefore difficult to remove.

Several prior art disclosures address sulfur contamination in refinery products. U.S. Pat. No. 2,769,760, for example, describes a hydrodesulfurization process with an additional conversion step that does not further reduce the sulfur level but converts some sulfur species to less corrosive forms, allowing the product to meet acidity requirements. Other disclosures are more specifically directed toward essentially complete sulfur removal from hydrocarbons. Particularly, the ability to oxidize sulfur compounds that are resistant to the aforementioned hydrogenation method is recognized in a number of cases. Oxidation has been found to be beneficial because oxidized sulfur compounds have an increased propensity for removal by a number of separation processes that rely on the altered chemical properties such as the solubility, volatility, and reactivity of such compounds. Techniques for the removal of oxidized organic sulfur compounds therefore include extraction, distillation, and adsorption.

In U.S. Pat. No. 3,163,593, organic sulfur compounds contained in petroleum fractions are oxidized by contact with a mixture of $H_2O_2$ and a carboxylic acid to produce sulfones, which are then degraded by thermal treatment to volatile sulfur compounds. In U.S. Pat. No. 3,413,307, thiophene and thiophene derivatives are oxidized to sulfones in the presence of a dilute acid. The sulfones are then extracted using a caustic solution. In U.S. Pat. No. 3,341,448, the oxidation and thermal treatment steps are combined with hydrodesulfurization to greatly reduce the hydrocarbon sulfur content. As noted previously, the oxidation and hydrogenation techniques are effective for converting different types of organic sulfur-containing species, thereby leading to a synergistic effect when these methods are combined.

In U.S. Pat. No. 3,505,210, sulfur contaminants in a hydrocarbon fraction are oxidized using hydrogen peroxide or other suitable oxidizing agent to convert bivalent sulfur to sulfones. The hydrocarbon, after having been subjected to oxidation conditions, is then contacted in this case with molten sodium hydroxide to produce a treated product of reduced sulfur content. Another example of a two-step oxidation and extraction method is provided in U.S. Pat. No. 3,551,328, where the extractant is a paraffinic hydrocarbon comprising a 3 to 6 carbon number alkane. Also, EP 0565324 A1 teaches the effectiveness of oxidizing sulfur-containing compounds followed by removal according to a number of possible separations known in the art.

In contrast to the prior art, applicant has determined that organic sulfur contaminants in hydrocarbon feed streams can be removed by a three component catalyst/adsorbent blend. The hydrocarbons purified by contact with this catalyst/adsorbent blend can now be used while the volatile sulfur is easily separable upon regeneration of the catalyst/adsorbent blend.

SUMMARY OF THE INVENTION

The present invention provides a process that is effective for the removal of organic sulfur compounds, organic nitrogen compounds and light olefins from liquid hydrocarbons and paraffins. The process more specifically addresses the removal of these contaminants from aromatic compounds including benzene and toluene and from naphtha. The liquid hydrocarbons are contacted at a temperature between about 200 to 250° C. with a blend of at least one metal oxide and an acidic zeolite. Preferably, the metal oxide comprises a mixture of NiO and $MoO_3$ and the acidic zeolite is acid stabilized zeolite Y. This blend has a significant capacity for adsorption of impurities and can be regenerated by oxidative treatment.

DETAILED DESCRIPTION OF THE INVENTION

The feed to the process of the present invention comprises broadly any liquid hydrocarbon stream contaminated with an organic sulfur-containing compound. More particularly applicable, however, are straight run and cracked oil refinery streams including naphtha, gasoline, diesel fuel, jet fuel, kerosene, and vacuum gas oil. These petroleum distillates invariably contain sulfur compounds, the concentrations of which depend on several factors including the crude oil source, specific gravity of the hydrocarbon fraction, and the nature of upstream processing operations.

The present invention has been found to be particularly effective for converting sterically hindered sulfur compounds such as thiophene derivatives that are known to be essentially non-reactive in hydrotreating (or hydrodesulfurization) reaction environments. For this reason, the method of the present invention may be practiced either before or after conventional hydrotreating is performed on any of the aforementioned feed stocks to significantly enhance overall sulfur removal efficiency. If hydrotreating is performed first, the liquid hydrocarbon feed stream to the present invention is a hydrotreated naphtha, hydrotreated gasoline, hydrotreated diesel fuel, hydrotreated jet fuel, hydrotreated kerosene, or hydrotreated vacuum gas oil. Alternatively, hydrotreating can also be performed after the oxidation and decomposition steps to yield a high quality sulfur-depleted product.

Specific types of sulfur compounds of utmost concern in the refining industry, due to their refractory nature in otherwise effective hydrotreating environments, include thiophene, benzothiophene, dibenzothiophene and alkylated dibenzothiophenes. Alkylated dibenzothiophenes include the various isomers of methyl-substituted dibenzothiophenes such as 4-methyldibenzothiophene; 2,8-dimethyldibenzothiophene; and 3,7-dimethyldibenzothiophene.

The hydrocarbon streams treated may start with as much as 10,000 ppm sulfur and sulfur compounds and typically between 1 to 1,000 ppm. The present invention is effective in reducing the level of sulfur and sulfur compounds in the effluent feed after treatment of the hydrocarbon stream to between 0.1 to 50 ppm, preferably to between 0.1 to 25 ppm and most preferably to between 0.1 to 10 ppm.

EXAMPLE 1

In the practice of the present invention, a hydrocarbon feed stream is first passed though a catalyst/adsorbent bed containing at least one metal oxide and one acidic zeolite. In preferred embodiments of the invention, the metal oxide is NiO, $MoO_3$ or mixtures thereof and the acidic zeolite is an acidic stabilized zeolite Y. This adsorbent bed is typically operated at a temperature between 200° and 250° C. and in the runs summarized in Table 1, at 240° C. A hydrocarbon feed containing 250 ppm thiophene (93 ppm sulfur) was processed at this temperature over 20 ml of the catalyst/adsorbent blend at a liquid hourly space velocity (LHSV) of 1.

After the adsorbent beds reached their capacity for removal of sulfur from the feed, a regeneration procedure is followed to remove the adsorbed sulfur from the adsorbent bed. A gas or liquid is sent through the bed, which is maintained at an elevated temperature for a sufficient period of time for the bed to be regenerated through the removal of the contaminants. Regeneration at 600° C. for four hours under air was found to be effective. Other gases or liquids may be used. The bed may also be regenerated in accordance with the other procedures as known to those skilled in the art. As shown in Table 1, the use of the acidic stabilized zeolite Y was 10 to 20 times more effective in increased thiophene capacity as compared to the nonacidic Y zeolite. Some improvement in performance was found in the combination of the two metal oxides.

TABLE 1

| Catalyst/ Adsorbent | NiO wt-% | $MoO_3$ wt-% | Acidic Y, wt-% | Nonacidic Y, wt-% | Binder wt-% | Thiophene Capacity wt-% for toluene feed |
|---|---|---|---|---|---|---|
| Fresh | 5 | 15 | 60 | 0 | 20 | 1.47 |
| 1st regenerated | 5 | 15 | 60 | 0 | 20 | 1.67 |
| 2nd regenerated | 5 | 15 | 60 | 0 | 20 | 1.76 |
| Fresh | 0 | 15 | 60 | 0 | 25 | 0.88 |
| Fresh | 5 | 25 | 60 | 0 | 10 | 1.08 |
| Fresh | 0 | 25 | 60 | 0 | 15 | 0.77 |
| Fresh | 5 | 15 | 0 | 60 | 20 | 0.088 |
| Fresh - Feed is benzene | 5 | 15 | 60 | 0 | 20 | >19 |

EXAMPLE 2

In example 2, the effectiveness of the catalyst/adsorbent of the present invention in removing sulfur, nitrogen compounds and olefins was tested. While the 5% NiO, 15% $MoO_3$, 60% acidic stabilized Y zeolite, 20% binder (percentages by weight) mixture was effective in the removal of these impurities, it was found that further improvement was produced by sending the feed through a carbon bed. The bromine index is an indicator of the olefin content. The bromine index is determined in accordance with the procedure spelled out in UOP Method 304-90 (incorporated by reference in its entirety herein), obtainable through the ASTM, Philadelphia, Pa. In accordance with this procedure a sample is dissolved in a titration solvent containing a catalyst that aids in the titration reaction. The solution is titrated potentiometrically at room temperature with either a 0.25 M or 0.001 M bromide-bromate solution depending upon whether bromine number or bromine index, respectively, is being determined. The titration uses a platinum indicating and a glass reference electrode in conjunction with a recording potentiometric titrator. Bromine number or index is calculated from the volume of titrant required to reach a stable endpoint.

The nitrogen content is determined in accordance with ASTM test method D 4629-86 (also referred to as D6069). This method is entitled "Standard Test Method for Organically Bound Trace Nitrogen in Liquid Petroleum Hydrocarbons by Oxidative Combustion and Chemiluminescence Detection." In accordance with this test method, a sample of liquid petroleum hydrocarbon is injected into a stream of inert gas (helium or argon). The sample is vaporized and carried to a high temperature zone where oxygen is introduced and organic and bound nitrogen is converted to nitric oxide which contacts ozone and is converted to $NO_2$. The light emitted as the $NO_2$ decays is detected by a photomultiplier tube and the resulting signal is a measure of the nitrogen contained in the sample.

The APHA color measurement was made in accordance with ASTM Method D1209-00, Stand Test Method for Color of Clear Liquids (Platinum-Cobalt Scale).

TABLE 2

| Test Method | Benzene feed | Mixture at 200° C. | Mixture at 200° C. with carbon bed | Mixture at 250° C. | Mixture at 250° C. with carbon bed |
|---|---|---|---|---|---|
| Bromine Index | 69 | <1 | <1 | 2 | <1 |
| APHA Color | 6 | 283 | 24 | Too high | 17 |
| Total $N_2$ | 600 | 40 | 32 | 132 | <30 |
| Total S, ppm | 3 | <1 | <1 | 0.2 | 0.1 |

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A process for treating a hydrocarbon feed stream containing at least one impurity selected from the group consisting of organic sulfur compounds, organic nitrogen compounds and olefins, the process comprising contacting the hydrocarbon feed stream with a catalyst/adsorbent mixture comprising at least one metal oxide and at least one acidic zeolite, thereby yielding a purified effluent stream.

2. The process of claim 1 wherein said organic sulfur compound is selected from the group consisting of thiophene, benzothiophene, dibenzothiophene, alkylated dibenzothiophenes, and mixtures thereof.

3. The process of claim 1 wherein said hydrocarbon feed stream is selected from the group consisting of paraffin, naphtha, benzene, toluene, pyridine, gasoline, diesel fuel, jet fuel, kerosene, vacuum gas oil, and mixtures thereof.

4. The process of claim 1 wherein said hydrocarbon feed stream comprises at least one aromatic hydrocarbon.

5. The process of claim 1 wherein said hydrocarbon feed stream is selected from the group consisting of paraffin, naphtha, benzene, and toluene.

6. The process of claim 1 where said hydrocarbon feed stream contacts said catalyst/adsorbent blend at a temperature between about 200° to 250° C.

7. The process of claim 1 where said metal oxide is selected from the group consisting of oxides of chromium, molybdenum, tungsten, cobalt, rhodium, iridium, nickel, and mixtures thereof.

8. The process of claim 1 wherein said metal oxide is selected from the group consisting of nickel oxide, molybdenum oxide and mixtures thereof.

9. The process of claim 1 wherein said acidic zeolite comprises acidic stabilized zeolite Y.

10. The process of claim 1 wherein said metal oxide is a mixture of nickel oxide and molybdenum oxide and said acidic zeolite is acidic stabilized zeolite Y.

11. The process of claim 9 wherein said catalyst/adsorbent mixture comprises about 5 wt-% NiO, about 15 wt-% $MoO_3$, about 60 wt-% acidic stabilized zeolite Y and about 30 wt-% binder.

12. The process of claim 1 wherein said sulfur compound is present in said hydrocarbon feed stream at concentrations from about 1 to about 1000 ppm.

13. The process of claim 1 wherein said process further comprises regenerating said catalyst/adsorbent mixture.

14. The process of claim 1 further comprising passing said purified effluent stream through a carbon bed to produce a highly purified effluent stream.

15. The process of claim 1 wherein said sulfur compound is present in said purified effluent stream in amounts of about 0.1 to 10 ppm.

* * * * *